United States Patent [19]

Sauder

[11] Patent Number: 5,072,552

[45] Date of Patent: Dec. 17, 1991

[54] UNIVERSAL CORNER FLASHING SHINGLE AND FLASHING METHOD

[76] Inventor: Mark L. Sauder, P.O. Box 23, Grabill, Ind. 46741

[21] Appl. No.: 478,485

[22] Filed: Feb. 12, 1990

[51] Int. Cl.[5] ..... E04D 1/36

[52] U.S. Cl. ..... 52/58; 52/62; 52/219

[58] Field of Search ..... 52/58, 60, 200, 219, 52/62; 285/42–44, 424

[56] References Cited

U.S. PATENT DOCUMENTS

| | | | |
|---|---|---|---|
| 1,317,446 | 9/1919 | Hollaender, Jr. | 285/44 |
| 1,317,574 | 9/1919 | Grosvold | 285/44 |
| 2,140,407 | 12/1938 | Schilling | 52/60 X |
| 3,977,137 | 8/1976 | Patry | 285/42 X |
| 4,372,585 | 2/1983 | Evora | 285/43 |
| 4,620,729 | 11/1986 | Kauffman | 285/424 X |
| 4,768,812 | 9/1988 | Katz | 285/43 |
| 4,970,837 | 11/1990 | Fogelstrom | 52/58 X |

*Primary Examiner*—David A. Scherbel
*Assistant Examiner*—Lan Mai
*Attorney, Agent, or Firm*—Lundy & Assoc.

[57] ABSTRACT

A corner flashing for use on a roof against a protrusion. The corner flashing comprises a base having a pair of intersecting joint edges and a wall joined in watertight relation to the base at the joint edges. The wall is an upstanding, folded, and adjustable portion. The folded portion has a plurality of folds tapering toward the base. The folded portion is inelastically deformable into a plurality of configurations between a fully open configuration and a fully closed configuration. The folded portion in the fully open configuration is approximately planar. The folded portion in the fully closed configuration has all adjacent folds contiguous. The folded portion is pivotable relative to the base by the deformation of the folded portion.

16 Claims, 3 Drawing Sheets

UNIVERSAL CORNER FLASHING SHINGLE AND FLASHING METHOD

BACKGROUND OF THE INVENTION

The present invention pertains to roofing materials and methods and more particularly pertains to a universal corner flashing shingle and flashing method.

Shingle roofs and roofs utilizing a number of other types of materials require the use of flashing around chimneys, dormers and other protrusions to prevent the entry of water between the roof and the protrusion. Flashing is generally applied in two layers. The outside layer is called counter-flashing. The counter-flashing is usually fastened to the protrusion. The purpose of counter-flashing is to force water falling down the vertical face or wall of the protrusion outwardly thereof and onto the inside layer of the flashing called the base flashing. The base flashing is fastened to the roof. The purpose of the base flashing is to force water falling off the counter flashing away from the protrusion and out on the top of the roof.

This two layer flashing system allows for a relative movement between the protrusion in the roof which extends the life of the flashing and any sealants that may be used.

Flashing is generally made from sheet metal, copper, lead, galvanized steel, aluminum and the like when installed properly may outlast several roofs. Such flashing is installed by cutting a piece of metal sheet and shaping it to fit while on the roof. To prevent the entry of water and insure long life, it is necessary that the flashing loosely conform to the shape of the roof and the protrusion to which it is attached. This presents a problem in that while protrusions, such as chimneys, generally have vertical walls, roofs are disposed in a wide variety of angles to protrusions, and the cutting and shaping of flashing while on the roof generally means preforming sheet metal work with only hand tools in an environment that is inconvenient and not condusive to accurate work. Counter-flashing fabrication is less difficult than base flashing fabrication. Vertical fall of the water over counter-flashing provides for less lateral movement and less water moving perpendicular to vertical seams in the counter-flashing. On a wood frame protrusion such as a dormer and/or vertical walls, the siding material may serve as counter-flashing.

The base flashing fabrication is generally more critical for water tight protection. On site fabrication is individualized to each project due to the wide variety of roof pitches. For example, a chimney on a pitched roof generally requires four different corner flashing layouts, require both flashing to masonary bonds and flashing seams that are hand soldered to provide water tight performance.

In practice, corner flashing is the most difficult to shape and install. Corner flashing is also where most of the leaks occur.

It is therefore highly desirable to provide an improved corner flashing and flashing method.

It is also highly desirable to provide an improved corner flashing and flashing method, utilizing a prefabricated corner flashing.

It is also highly desirable to provide an improved corner flashing and flashing method, usable, without modification on roofs having a wide variety of pitches.

It is also highly desirable to provide an improved corner flashing and flashing method, which quickly and easily results in watertight flashing.

It is also highly desirable to provide an improved corner flashing and flashing method which utilizes no roofing cement.

It is finally highly desirable to provide an improved corner flashing and flashing method, which meets all of the above desired features.

SUMMARY OF THE INVENTION

It is an object of the invention to provide an improved corner flashing and flashing method.

It is another object of the invention to provide an improved corner flashing and flashing method, utilizing a prefabricated corner flashing.

It is another object of the invention to provide an improved corner flashing and flashing method, usable, without modification on roofs having a wide variety of pitches.

It is another object of the invention to provide an improved corner flashing and flashing method, which quickly and easily results in watertight flashing.

It is another object of the invention to provide an improved corner flashing and flashing method, which utilizes no roofing cement.

It is finally an object of the invention to provide an improved corner flashing and flashing method, which meets all of the above desired features.

In the broader aspects of the invention there is provided a corner flashing, for use on a roof against a protrusion. The corner flashing comprises a base having a pair of intersecting joint edges and a wall joined in watertight relation to the base at the joint edges. The wall is an upstanding, folded, and adjustable portion. The folded portion has a plurality of folds tapering toward the base. The folded portion is inelastically deformable into a plurality of configurations between a fully open configuration and a fully closed configuration. The folded portion in the fully open configuration is approximately planar. The folded portion in the fully closed configuration has all adjacent folds contiguous. The folded portion is pivotable relative to the base by the deformation thereof.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
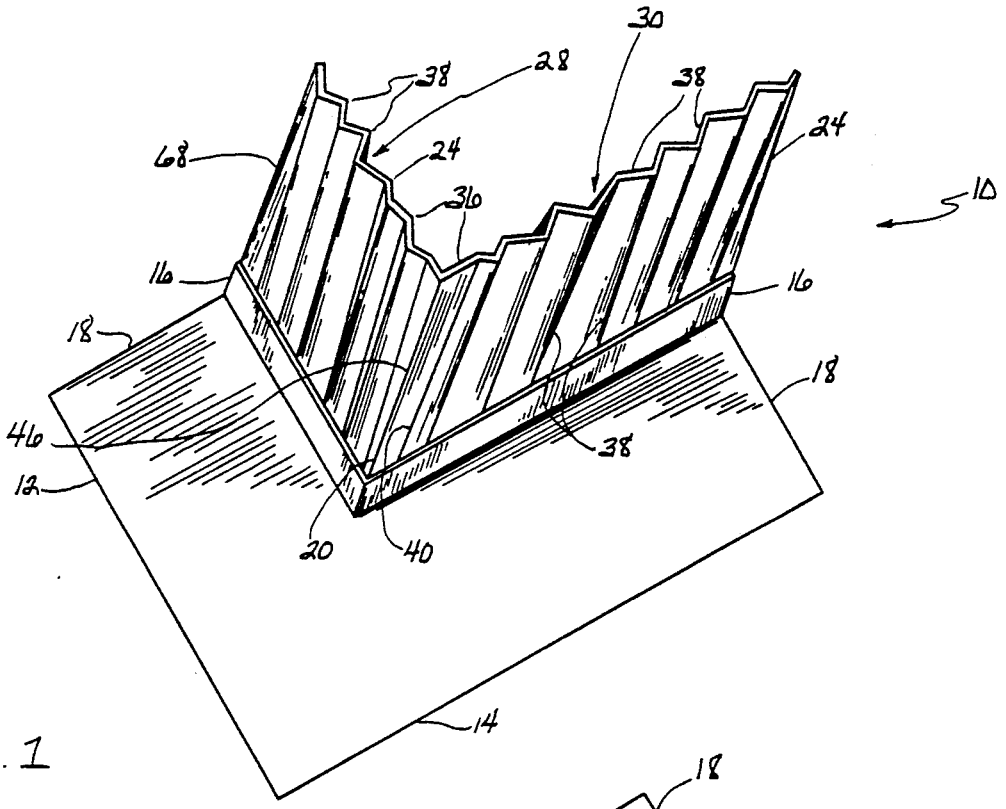
FIG. 1 is a perspective view of the corner flashing of the invention in one configuration.
Figure 2:
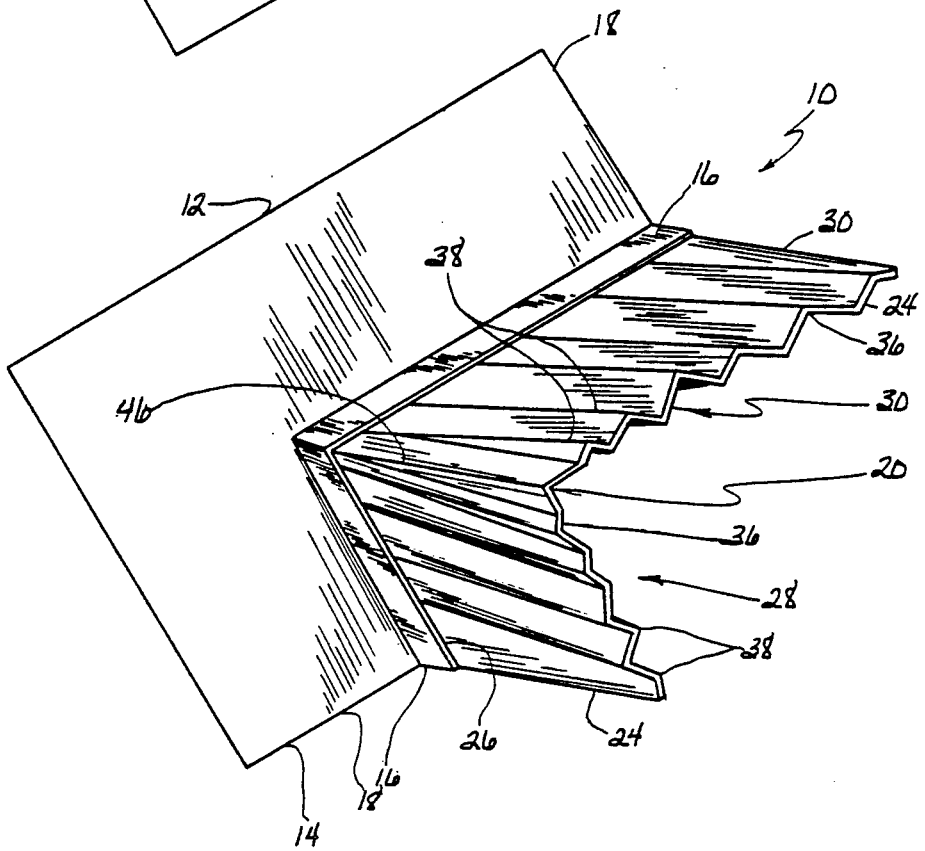
FIG. 2 is a perspective view of the corner flashing of the invention in another configuration which is the mirror image of the corner flashing of FIG. 1.

Referring now to FIG. 1, the corner flashing 10 of the invention, has a generally planar base 12, which has a main portion 14 and a pair of flanges 16. Main portion 14 has a pair of intersecting legs 18, which define between them, an indentation or indented corner 20. The corner flashing 10 of the invention may have a particular handedness as determined by the location of indented corner 20. Two alternative configurations of the corner flashing 10 of the invention, which are right and left handed mirror images, are illustrated in FIGS. 1 and 2. Flanges 16 are joined to and extend up from main portion 14 along indented corner 20.

A wall 24 is joined to and generally contiguous with outer side 26 of flanges 16 and extends up from base 12. Wall 24 is thus interior to main portion 14 and adjoins indented corner 20. Wall 24 has a side face 28 and a side face 30, which are generally orthogonal or are alternatively disposed at a greater or lesser angle to each other. Side faces 28, 30 each have an upstanding, folded and adjustable portion 36. Folded portion 36 has a plurality of folds 38, which are tapered together toward base 12. Folds 38 are angled, relative to side faces 28, 30 in a sequence of angles. The extension of all folds 38 out from side faces 28, 30 is about equal. The junction of adjustable portions 36 of faces 28, 30 is wall corner 46.

Corner flashing 10 is made of a thin but strong, waterproof and corrosion resistant material such as aluminum. Wall 24 and base 12 are joined in watertight relation and are free of perforations. Corner flashing 10 is readily deformable, but has limited resilience.

Figure 3:
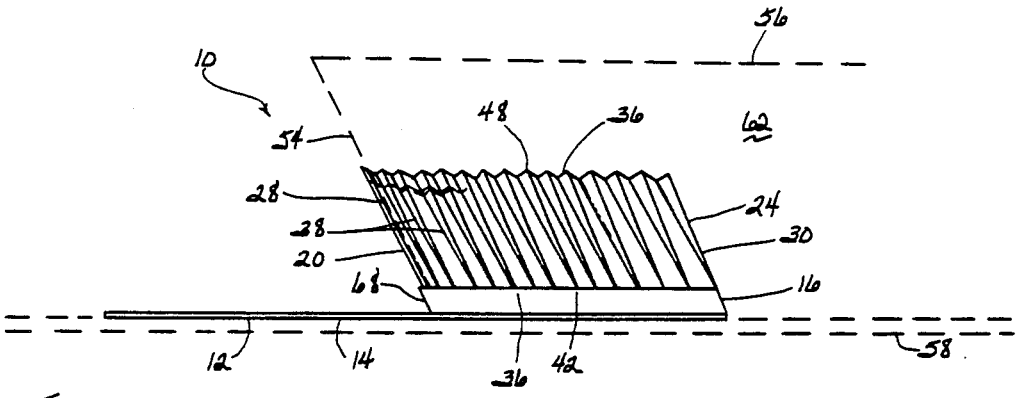
FIG. 3 is a side plan view of the corner flashing of FIG. 1, shown in a fully open configuration, positioned on a roof, with the side face of the corner flashing in registry with a protrusion. The roof and protrusion are indicated by dashed lines.
Figure 4:
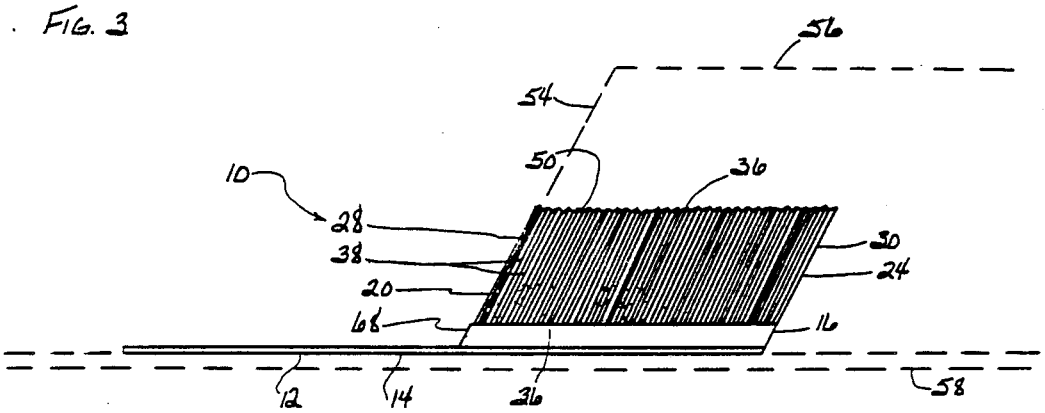
FIG. 4 is a side plan view of the corner flashing of FIG. 1, shown in a fully closed configuration positioned on a roof, with the side and front faces of the corner flashing in registry with a protrusion. The roof and protrusion are indicated by dashed lines.
Figure 5:
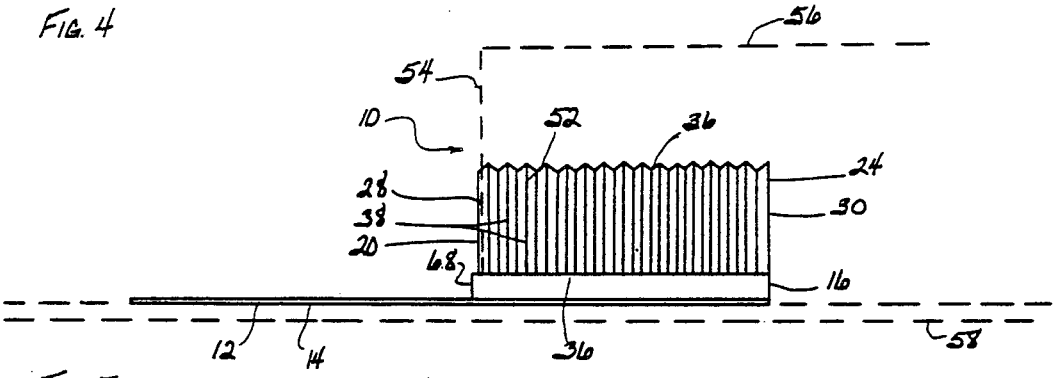
FIG. 5 is a side plan view of the corner flashing of FIG. 1, shown in an intermediate configuration positioned on a roof, with the side face of the corner flashing in registry with a protrusion. The roof and protrusion are indicated by dashed lines.

Referring now to FIGS. 3, 4 and 5, the folded portion 36 may be folded and unfolded, non-resiliently, to assume a plurality of configurations. In a fully open configuration 48, shown in FIG. 3, folded portion 36 is approximately planar. In a fully closed configuration 50, shown in FIG. 4, all adjacent folds 38 are nearly contiguous.

FIG. 5 shows one of a plurality of intermediate configurations 52, between fully open 48 and fully closed 50, which is also the initial configuration as manufactured of corner flashing 10 prior to folding or unfolding.

Adjustable portion 36 of side faces 28, 30 are pivotable relative to base 12, upon folding and unfolding of folded portion 36 of the other face. Face 28 is disposed at an acute angle to base 12, when folded portion 36 is in open configuration 48, as shown in FIG. 3. Similarly, face 28 is disposed at an obtuse angle to base 12, when folded portion 36 of face 30 is in closed configuration 50. See FIG. 4.

Figure 6:
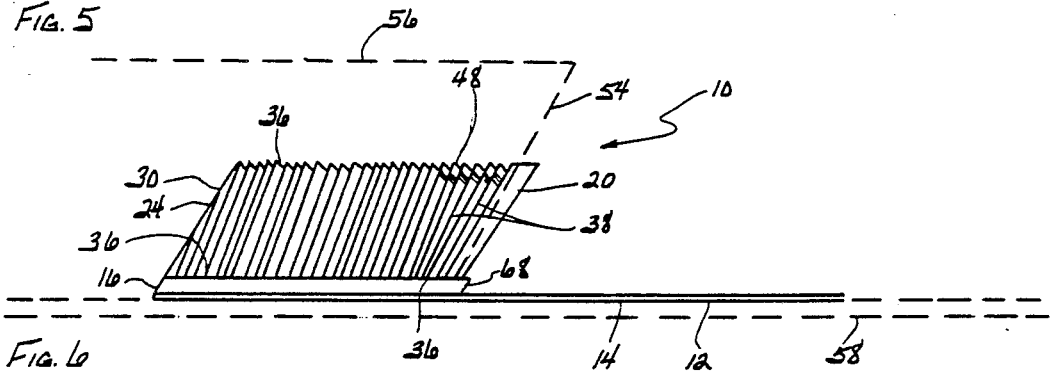
FIG. 6 is a side plan view of the corner flashing of the invention, shown in another intermediate configuration positioned on a roof, with the side face of the corner flashing in registry with a protrusion. The roof and protrusion are indicated by dashed lines.

In an alternative embodiment of the corner flashing 10 of the invention, front face 28 is disposed at an intermediate obtuse angle to base 12, when folded portion 36 is in fully open configuration 48, as shown in FIG. 6.

Figure 7:
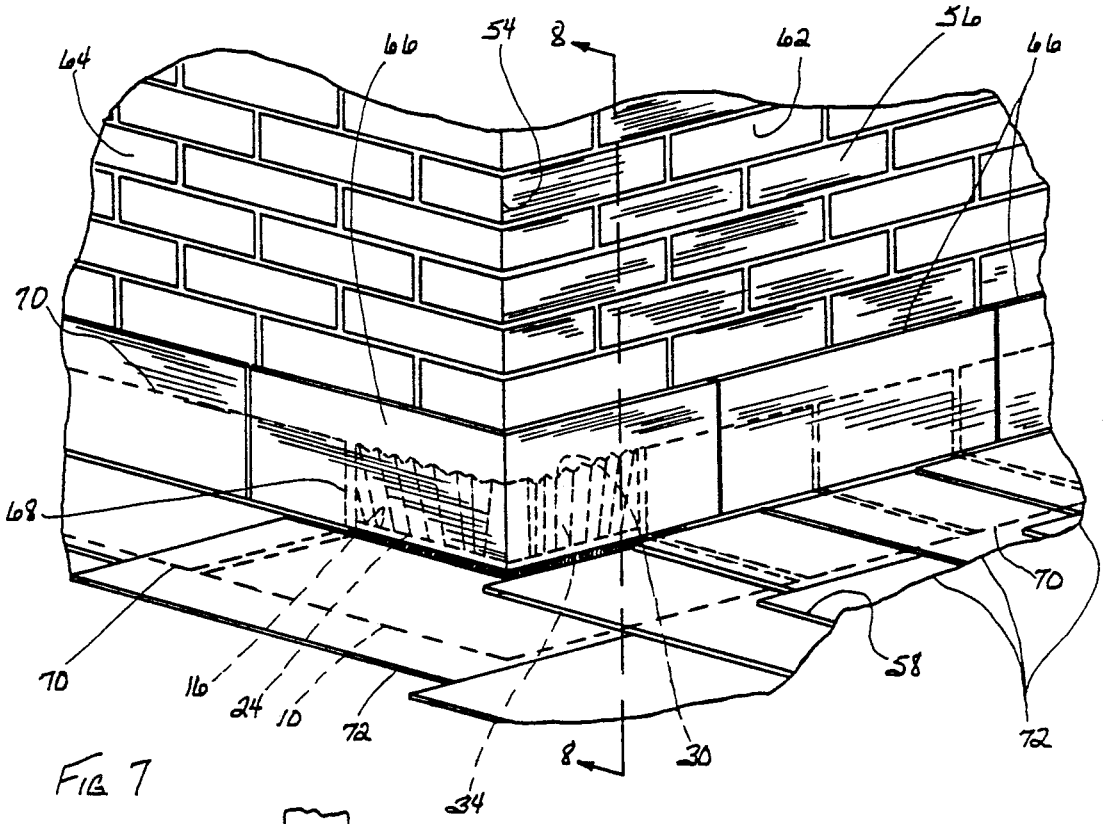
FIG. 7 is a perspective view of the corner flashing of FIG. 1, installed on a roof, against a protrusion, in accordance with the method of the invention.
Figure 8:
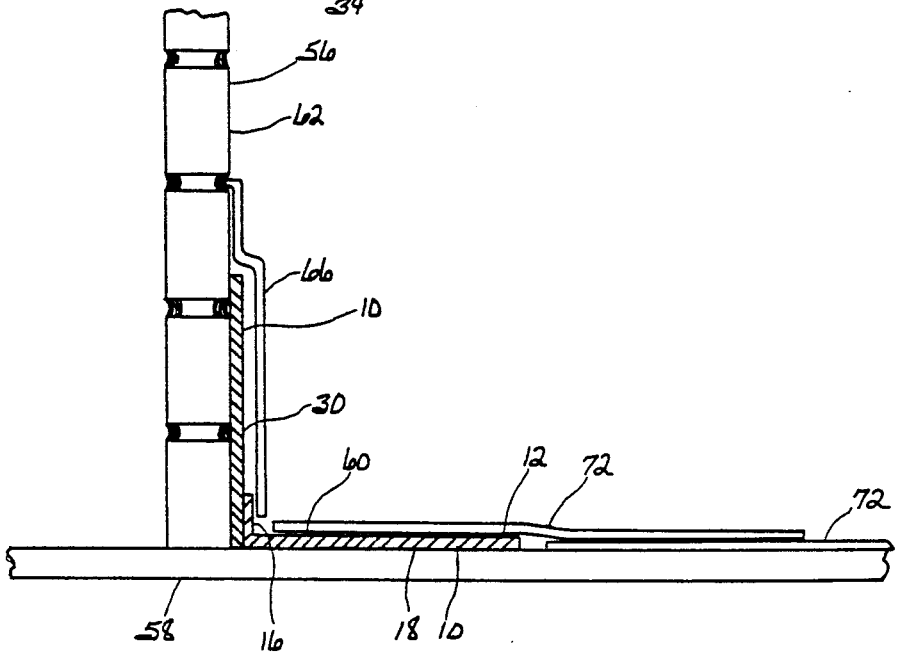
FIG. 8 is a partial cross-sectional view of the corner flashing of FIG. 7 taken along section line 8—8.

In use, corner flashing 10 is installed against one or more corners 54 of a protrusion 56 extending from a roof 58. Referring now to FIGS. 7 and 8, no roofing cement need be applied to the underside of corner flashing 10 or to roof 58 where corner flashing 10 is to be placed, at the corner 54 of protrusion 56, where roof 58 and sides 62, 64 of protrusion 56 meet to render the flashing of the invention watertight.

Referring now to FIG. 3, corner flashing 10 is then placed, on roof 58 in the immediate proximity fo first and second sides 62, 64 of protrusion 56. At the same time or after corner flashing 10 is placed on roof 58, side face 30 of corner flashing 10 is registered against side 62 of protrusion 56.

Since corner flashing 10 is used with overlapping upper or counter flashing 66, it is not necessary that side face 30 by contiguous or generally contiguous with protrusion side 62. Corner flashing 10 is not, however, rigidly bonded or fastened to protrusion 56, since relative movement of protrusion 56 and roof 58 would be likely to pull corner flashing 10 loose from roof 58.

Referring now to FIG. 5, simultaneously or subsequently, lower margin 68 of side face 28 is brought into contact with side 64 of protrusion 56. Face 28 of corner flashing 10 is pivoted relative to base 12, either prior to attachment or during attachment, to alter the angular relation between front face 28 and side 64 of protrusion 56. Folds 38 are non-resiliently compressed by that pivoting. Face 28 is not twisted relative to side face 30 during pivoting, in order to prevent warping of wall corner 46 and faces 28, 30. Deformation of side face 30 is limited to a change in the extent of folding of folded portion 36.

Face 28 is brought into registry with side 64 of protrusion 56. Since the folding of corner flashing 10 is a non-resilient deformation, front face 28 does not then spring back, but rather remains in place.

Flat flashing 70 is then applied to roof 58 against sides 62, 64 of protrusion 56, partially overlaying corner flashing 10. Shingles 72 are laid on roof 58 also partially overlaying corner flashing 10. No roofing cement need be applied between flashing 10 and 70 and shingles 72. Counter flashing 66 is affixed to protrusion 56 overlapping wall 24 and a part of flanges 16 of corner flashing 10. No roofing cement need be applied between flashing 66 and flashing 10 and 70. The same steps are repeated at all corners 54 of protrusion 56, utilizing for lower corners 54, corner flashing 10 illustrated in FIGS. 3, 4 and 5 and for upper corners 54 (not illustrated) corner flashing 10 of the embodiment shown in FIG. 6 and its mirror image.

Between the corner flashing of the invention, both the counter flashing and base flashing is shingled, each piece of counter flashing and base flashing having generally the same lateral dimensions as the roof shingles. Thus, both the counter flashing and the base flashing shingles have the same overlap as do the roof shingles and the water directed downwardly by the counter flashing is directed off the protrusion onto the roof without any seepage under the base flashing or roof shingles.

The embodiment of the invention disclosed herein is used with a vertically sided protrusion, such as a chimney or dormer extending from a pitched roof. The invention is not, however, limited to vertically sided protrusions, nor to pitched roofs.

The improved corner flashing and flashing method of the invention utilizes a prefabricated corner flashing which is usable without modification on roofs having a wide variety of pitches, allows for quick and easy installation, and provides for a watertight seal eliminating the prior difficulty of fabricating corner flashing on the roof from sheet material and the leaks which often occur at the corners.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A corner flashing for use on a roof against a protrusion comprising a base, said base having a pair of intersecting edges defining a corner therebetween, and a wall upstanding from said base, said wall being joined to said base in a watertight relation at said edges, said wall having a fold defining a corner at said intersecting edges, said base extending outwardly of said wall, said wall having at least one upstanding and folded adjustable portion and a remaining wall portion, said folded portion having a plurality of upstanding folds tapering together towards said base, said folded portion being non-resiliently deformable into a plurality of configuations between a fully open configuration and a fully closed configuration, said folded portion in said fully open configuration being approximately planar, said folded portion in said fully closed configuration having all adjacent folds contiguous, said remaining wall portion being pivotable relative to said base by said deformation of said folded portion.

2. The corner flashing of claim 1 wherein said folds include at least one fold disposed generally perpendicular to said edges and at least one fold generally disposed at an oblique angle to said edges, and at least one intermediate fold disposed at an angle to said edges between perpendicular and said oblique angle.

3. The corner flashing of claim 2 wherein said wall has two upstanding faces, said folds being in one of said faces, said folds including a plurality of intermediate folds disposed at sequential angles to the other of said faces between parallelism and said oblique angle.

4. The corner flashing of claim 3 wherein both of said faces have folds therein, said one and other faces and said folded and remaining portions being interchangeable depending upon which portion and which face is being pivoted relative to said base.

5. The corner flashing of claim 3 wherein said one face and said folded portion are the same.

6. The corner flashing of claim 3 wherein said other face and said remaining portion are the same.

7. The corner flashing of claim 1 wherein said edges define an indentation of said base.

8. The corner flashing of claim 1 wherein said base has a main portion and a pair of flanges extending up from said main portion, said flanges being joined to said wall in generally contiguous relation.

9. The corner flashing of claim 8 wherein said wall is joined to said base with said flanges exterior of said wall.

10. The corner flashing of claim 1 wherein said adjustable portion is disposed at an obtuse angle to said base when said folded portion is in said fully open configuration.

11. The corner flashing of claim 1 wherein said adjustable portion is disposed at an acute angle to said base when said folded portion is in said fully closed configuration.

12. A corner flashing comprising a base having a pair of intersecting legs defining an indented corner, a wall joined in watertight relation to said base at said indented corner and upstanding from said base, said wall having side faces disposed at the angle of said corner, said faces both having an adjustable portion, said adjustable portions having a plurality of folds tapering together toward said base, said adjustable portions being non-resilently deformable into a plurality of configurations between a fully open configuration and a fully closed configuration, said adjustable portions in said fully open configuration being approximately planar, said adjustable portions in said fully closed configuration having all adjacent folds contiguous, said faces each being pivotable relative to said base by said deformation of said adjustable portion of the other of said faces.

13. The corner flashing of claim 9 wherein said folds include at least one fold disposed generally perpendicular to said edges and at least one fold generally disposed at an oblique angle to said edges, and at least one intermediate fold disposed at an angle to said edges between said perpendicular and said oblique angle.

14. A corner flashing for use on a roof against a protrusion comprising a base and an upstanding wall, said wall being folded to define a corner, said base and wall being of a material which is impervious to water, said base and wall being a unitary watertight structure, said wall having a folded portion with a plurality of folds tapering together toward said base, said folded portion being non-resiliently deformable into a plurality of configurations between a fully open configuration and a fully closed configuration, said wall having another wall portion, said other wall portion being pivotable relative to said base by said deformation of said folded portion, said folds including at least one fold being disposed generally perpendicular to said base and at least one fold being generally disposed at an oblique angle to said base, and at least one intermediate fold disposed at an angle to said base between the perpendicular and said oblique angle, said folds including a plurality of intermediate folds disposed at sequential angles to the other wall portion between parallelism and said oblique angle.

15. The corner flashing of claim 14 wherein said other portion is disposed at an obtuse angle to said base when said folded portion is in said fully open configuration.

16. The corner flashing of claim 14 wherein said other portion is disposed at an acute angle to said base when said folded portion is in said fully closed configuration.

* * * * *